US006955105B2

(12) United States Patent
Chen

(10) Patent No.: US 6,955,105 B2
(45) Date of Patent: Oct. 18, 2005

(54) WRENCH WITH MAGNET

(76) Inventor: Chuan-Chen Chen, No. 13-10, Ni Ku An, Ta Pi Hsiang, Yuan Lin Hsien (TW)

( * ) Notice: Subject to any disclaimer, the term of this patent is extended or adjusted under 35 U.S.C. 154(b) by 546 days.

(21) Appl. No.: 10/134,793

(22) Filed: Apr. 29, 2002

(65) Prior Publication Data

US 2003/0041699 A1 Mar. 6, 2003

(30) Foreign Application Priority Data

Aug. 28, 2001 (TW) ..... 90214851 U

(51) Int. Cl.[7] ..... B25B 13/02
(52) U.S. Cl. ..... 81/125; 81/900
(58) Field of Search ..... 81/125, 900, 451, 81/119, 121.1

(56) References Cited

U.S. PATENT DOCUMENTS 4,823,652 A * 4/1989 Morrissey et al. ..... 81/125
5,307,713 A * 5/1994 White ..... 81/119
5,924,343 A * 7/1999 Bogni et al. ..... 81/125
6,295,899 B1 * 10/2001 Lee ..... 81/179

* cited by examiner

*Primary Examiner*—Debra S. Meislin
(74) *Attorney, Agent, or Firm*—Alan D. Kamrath; Nikolai & Mersereau, P.A.

(57) ABSTRACT

A wrench includes a handle, a head formed at an end of the handle for engagement with a nut and a magnet embedded in the head. In an aspect, the head includes an intermediate portion and two jaws extending from the intermediate portion. The magnet is embedded in the intermediate portion or one of the jaws. Alternatively, a magnet is embedded in each of the jaws. In another aspect, the head is a ring for engagement with the nut. The magnet is embedded in the ring or includes a first tip embedded in the ring and an exposed second tip. Thus, the second tip of the magnet performs as a stop for the nut. In another aspect, the wrench is a quick-release wrench. The intermediate portion includes two surfaces for contact with two adjacent facets of the nut. The magnet is embedded in one of the surfaces of the intermediate portion. Another magnet may be embedded in the remaining one of the surfaces of the intermediate portion. In another aspect, the wrench is an adjustable wrench including a handle, a fixed jaw projecting from the handle and a movable jaw mounted thereon. The movable jaw can be moved toward and away from the fixed jaw by operation of a worm and rack mechanism. The magnet is embedded in the fixed jaw or movable jaw. In another aspect, the head includes facets for contact with facets of the nut. The magnet is embedded in one of the facets of the head.

20 Claims, 15 Drawing Sheets

WRENCH WITH MAGNET

BACKGROUND OF INVENTION

1. Field of Invention

The present invention is related to a wrench with a magnet.

2. Related Prior Art

A typical conventional wrench includes a handle, a first pair of jaws extending from a first end of the handle and a second pair of jaws extending from a second end of the handle. Each pair of jaws can be engaged with a nut or bolt. Thus, a user can drive the nut or bolt by pivoting the handle. In using the wrench to drive the nut, a user has to be careful about the nut or bolt in order not to lose the nut or bolt The user often has to operate the wrench with one hand and hold the nut with the other hand. This could be difficult for the user particularly when operating the wrench in a narrow space such as a nacelle.

Taiwanese Patent Publication No. 359212 teaches a wrench. The wrench includes a handle, a first pair of jaws extending from an end of the handle and a second pair of jaws extending from the other end of the handle A groove is defined in each pair of jaws, extending from the tip of a jaw to the tip of the other jaw. A U-shaped magnet is received in the groove defined in each pair of jaws. During an operation of such a wrench on a nut or bolt, the U-shaped magnet avoids the nut or bolt leaving the wrench. However, the U-shaped magnet must be precisely made and finished so that it does not hinder engagement of each pair of jaws with the nut or bolt. Generally, only two short sections of the U-shaped magnet contact the nut or bolt. Hence, use of the U-shaped magnet entails a waste of material.

Taiwanese Patent Publication No. 435307 teaches a magnetic device for various hand tools. However, during an operation of such a hand tool on a nut or bolt, the magnetic device cannot avoid the nut or bolt leaving the hand tool due to the position of the magnetic device on the hand tool.

The present invention is therefore intended to obviate or at least alleviate the problems encountered in the prior art.

SUMMARY OF INVENTION

It is an objective of the present invention to provide a wrench with a magnet that keeps a nut on the wrench when the wrench is operated on the nut or bolt.

It is another objective of the present invention to provide a wrench with a magnet that does not hinder engagement of the wrench with a nut.

It is another objective of the present invention to provide an inexpensive wrench with a magnet.

According to the present invention, a wrench includes a handle, a head formed at an end of the handle for engagement with a nut and a magnet embedded in the head.

In an aspect, the head includes an intermediate portion and two jaws extending from the intermediate portion. The magnet is embedded in the intermediate portion or one of the jaws. Alternatively, a magnet is embedded in each of the jaws.

In another aspect, the head is a ring for engagement with the nut. The magnet is embedded in the ring or includes a first tip embedded in the ring and an exposed second tip. Thus, the second tip of the magnet performs as a stop for the nut.

In another aspect, the wrench is a quick-release wrench. The intermediate portion includes two surfaces for contact with two adjacent facets of the nut. The magnet is embedded in one of the surfaces of the intermediate portion. Another magnet may be embedded in the other one of the surfaces of the intermediate portion.

In another aspect, the wrench is an adjustable wrench including a handle, a fixed jaw projecting from the handle and a movable jaw mounted thereon. The movable jaw can be moved toward and away from the fixed jaw by operation of a worm and rack mechanism. The magnet is embedded in the fixed jaw or the movable jaw.

In another aspect, the head includes facets for contact with facets of the nut. The magnet is embedded in one of the facets of the head.

Other objectives, advantages, and novel features of the invention will become more apparent from the following detailed description when taken in conjunction with the attached drawings.

BRIEF DESCRIPTION OF DRAWINGS

The present invention is described through detailed illustration of embodiments referring to the attached drawings wherein.

DETAILED DESCRIPTION OF EMBODIMENTS

Figure 1:
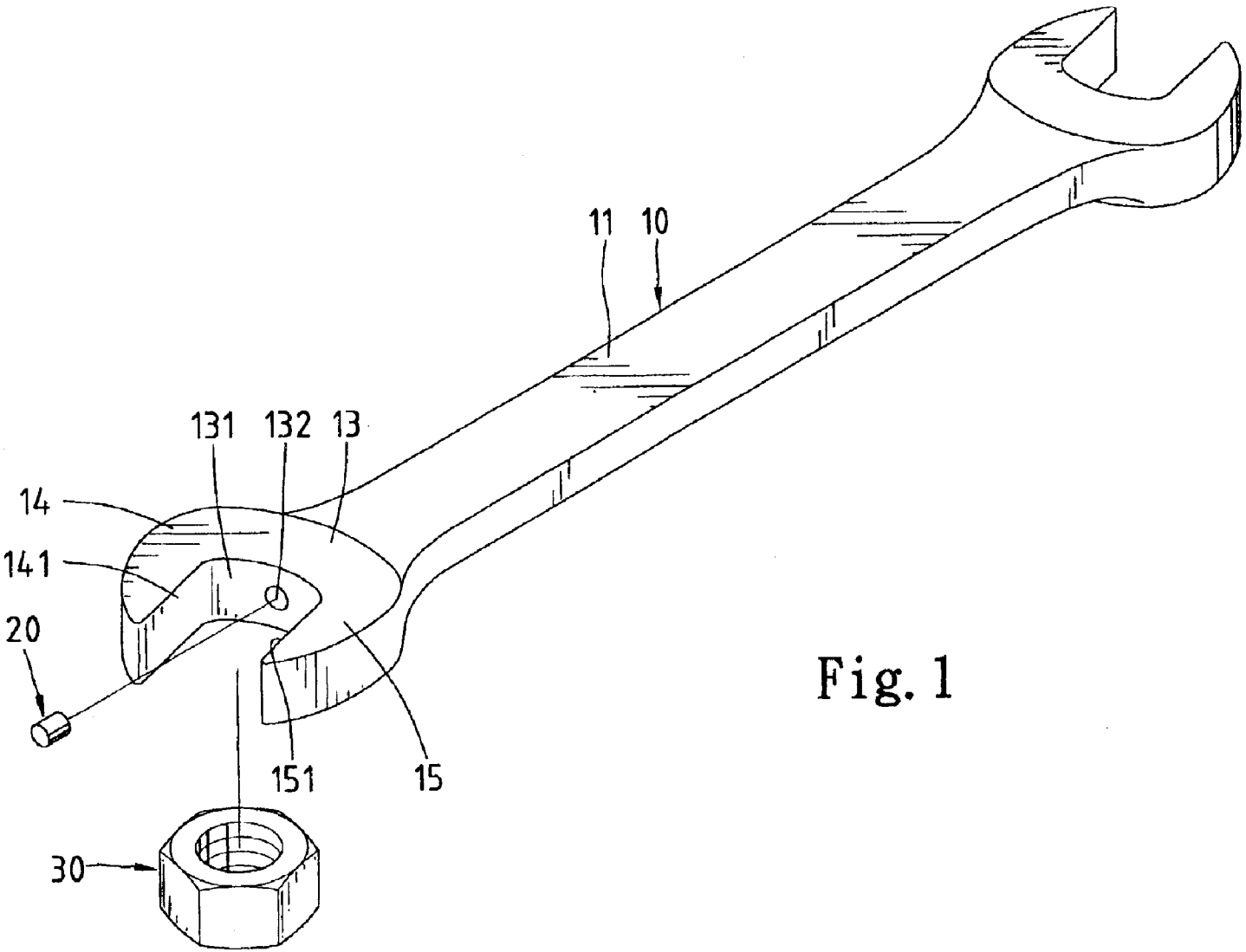
FIG. 1 is an exploded view of a wrench with a magnet according to an embodiment of the present invention.
Figure 2:
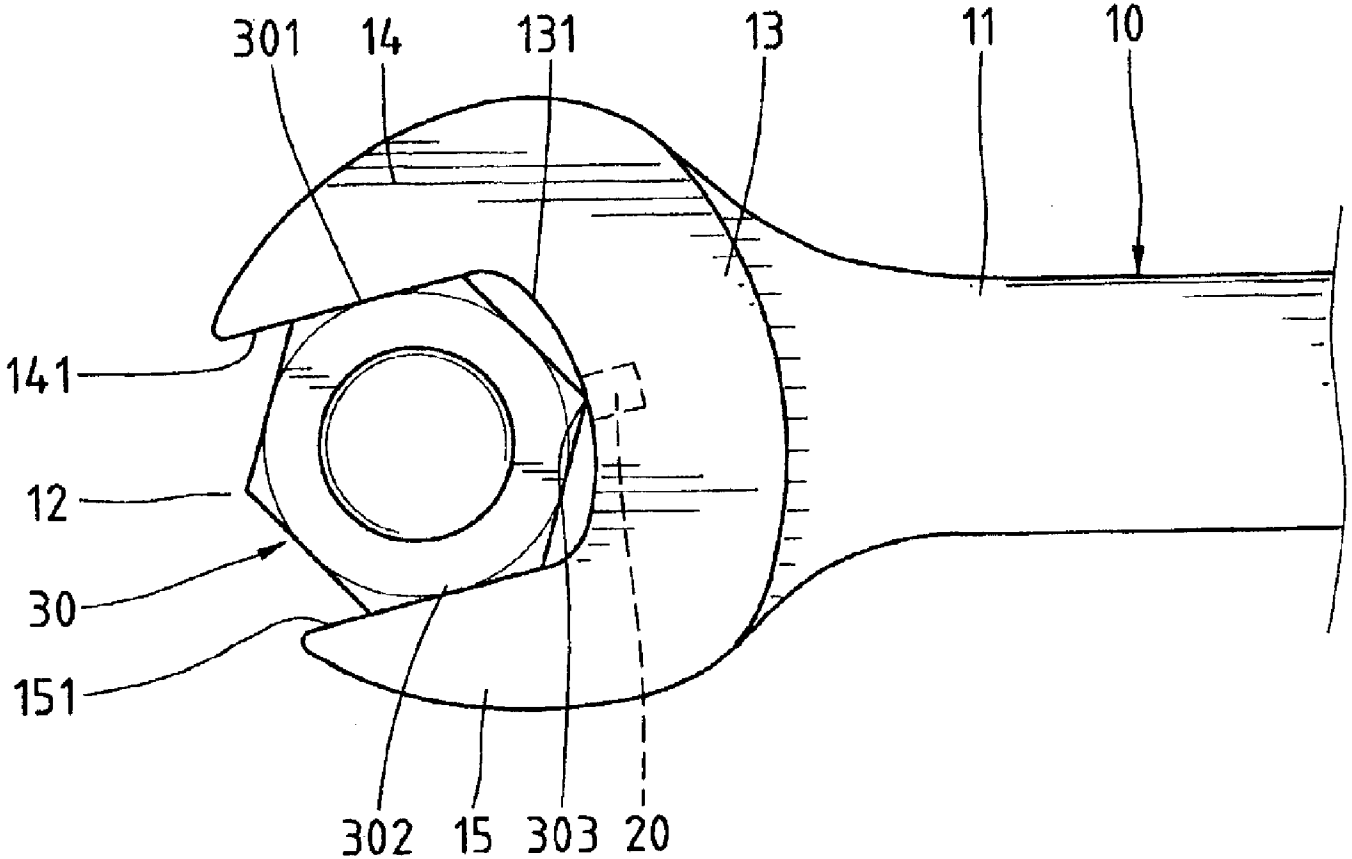
FIG. 2 is a partial, top view of the wrench shown in FIG. 1 engaged with a nut.
Figure 3:
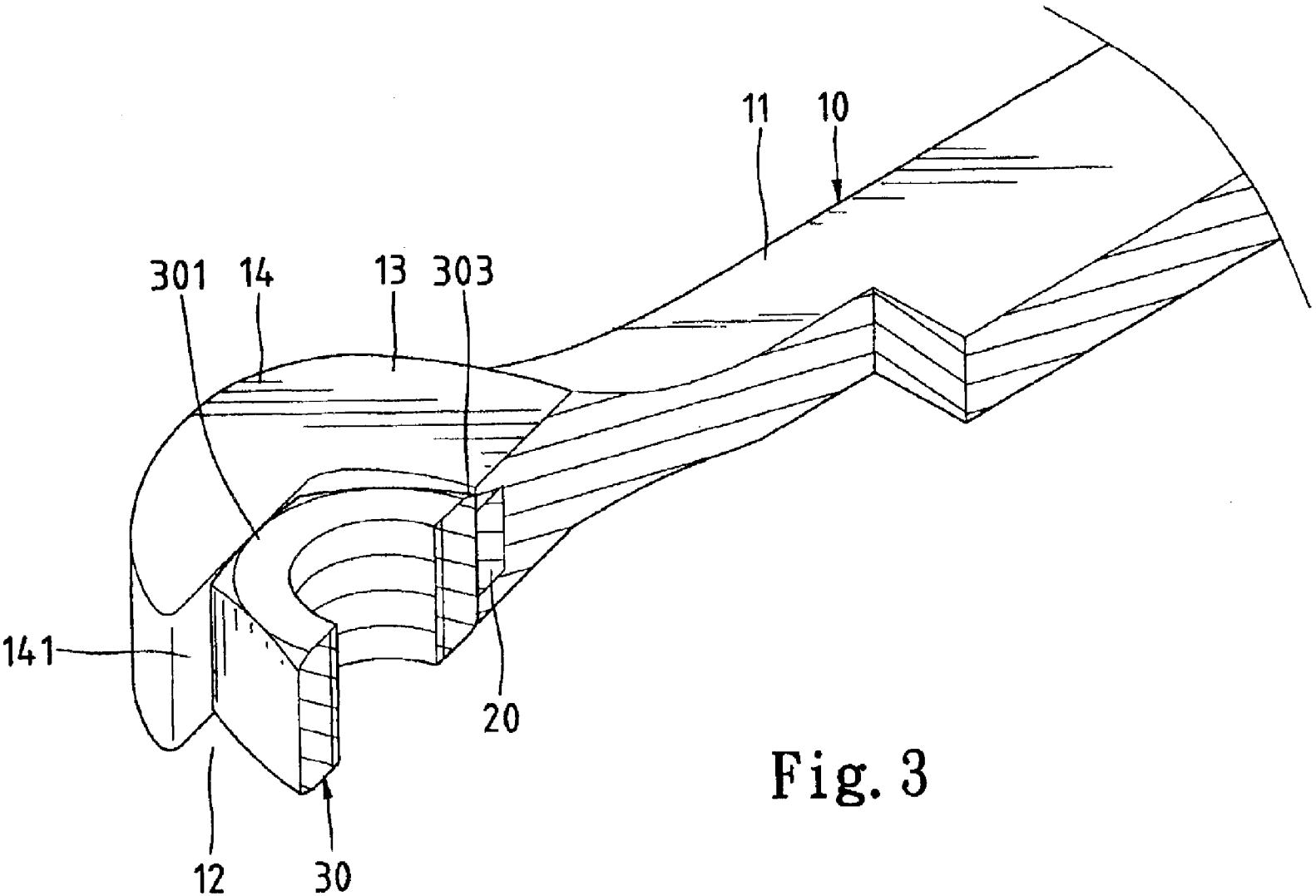
FIG. 3 is a partially cut away perspective view of the wrench shown in FIG. 1 engaged with a nut.

FIGS. 1–3 show a wrench 10 according to an embodiment of the present invention. The wrench 10 includes a handle 11 and at least one head 12 formed at an end of the handle 11. The head 12 includes an intermediate portion 13 and a pair of jaws 14 and 15 extending from the intermediate portion 13. The intermediate portion 13 includes a surface 131 in which a hole 132 is centrally defined. A magnet 20 is fit in the hole 132. The jaw 14 includes a surface 141. The jaw 15 includes a surface 151. The surfaces 141 and 151 are parallel to each other for contact with two parallel facets of a nut 30.

Referring to FIG. 2, when the head 12 is engaged with the nut 30, the surfaces 141 and 151 are in contact with two parallel facets 301 and 302 of the nut 30, and the magnet 20 is in contact with a corner 303 of the nut 30. Attraction between the magnet 20 and the nut 30 ensures the engagement of the head 12 with the nut 30.

Figure 4:
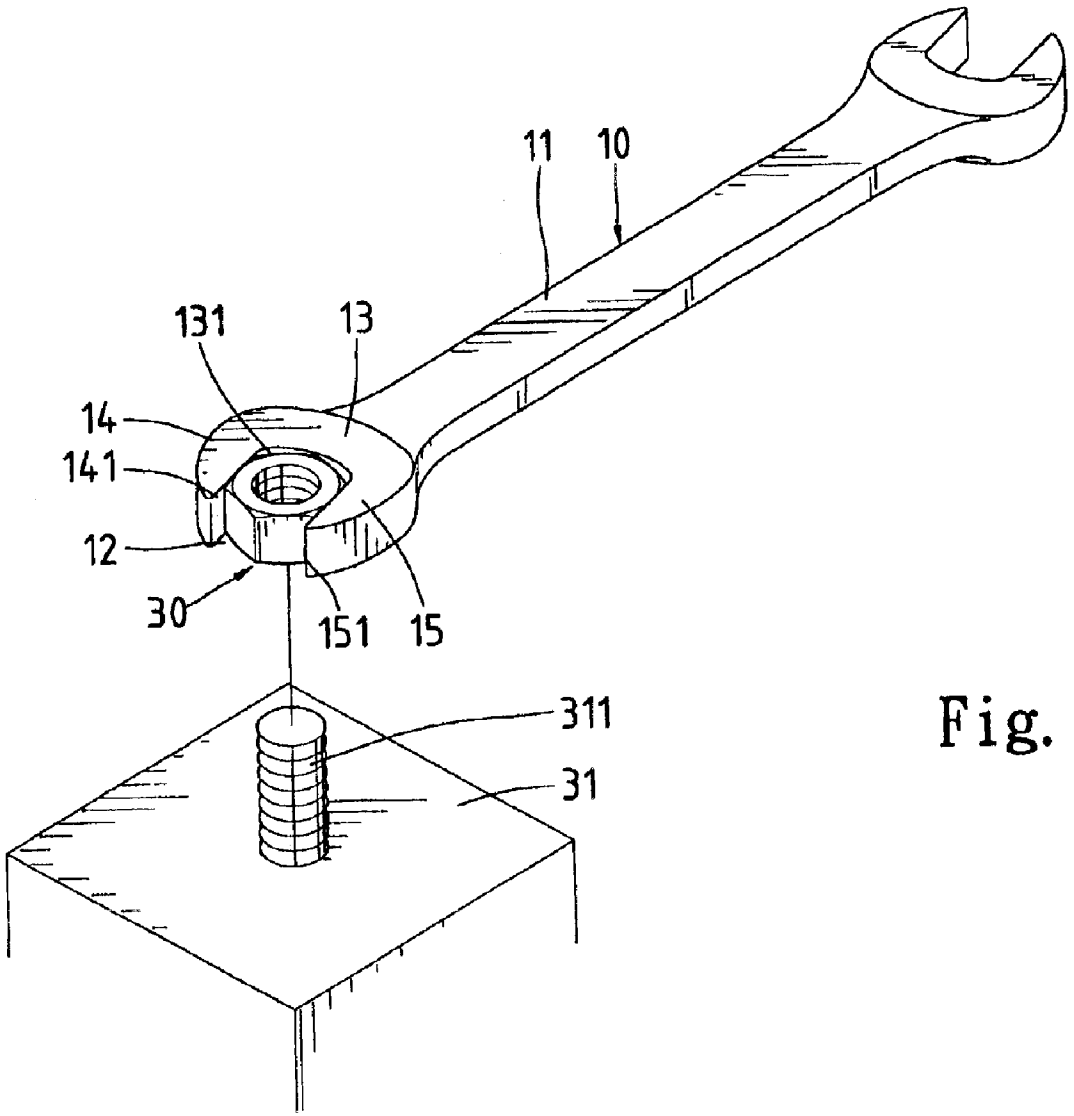
FIG. 4 is a perspective view of the wrench shown in FIG. 1 used in a first condition.

FIG. 4 shows a work 31 from which a bolt 311 projects. Due to the attraction between the magnet 20 and the nut 30, a user can secure the nut 30 onto the bolt 311 or remove the nut 30 from the bolt 311 with One hand and does not have to worry about accidentally dropping the nut 30 from the head 12.

Figure 5:
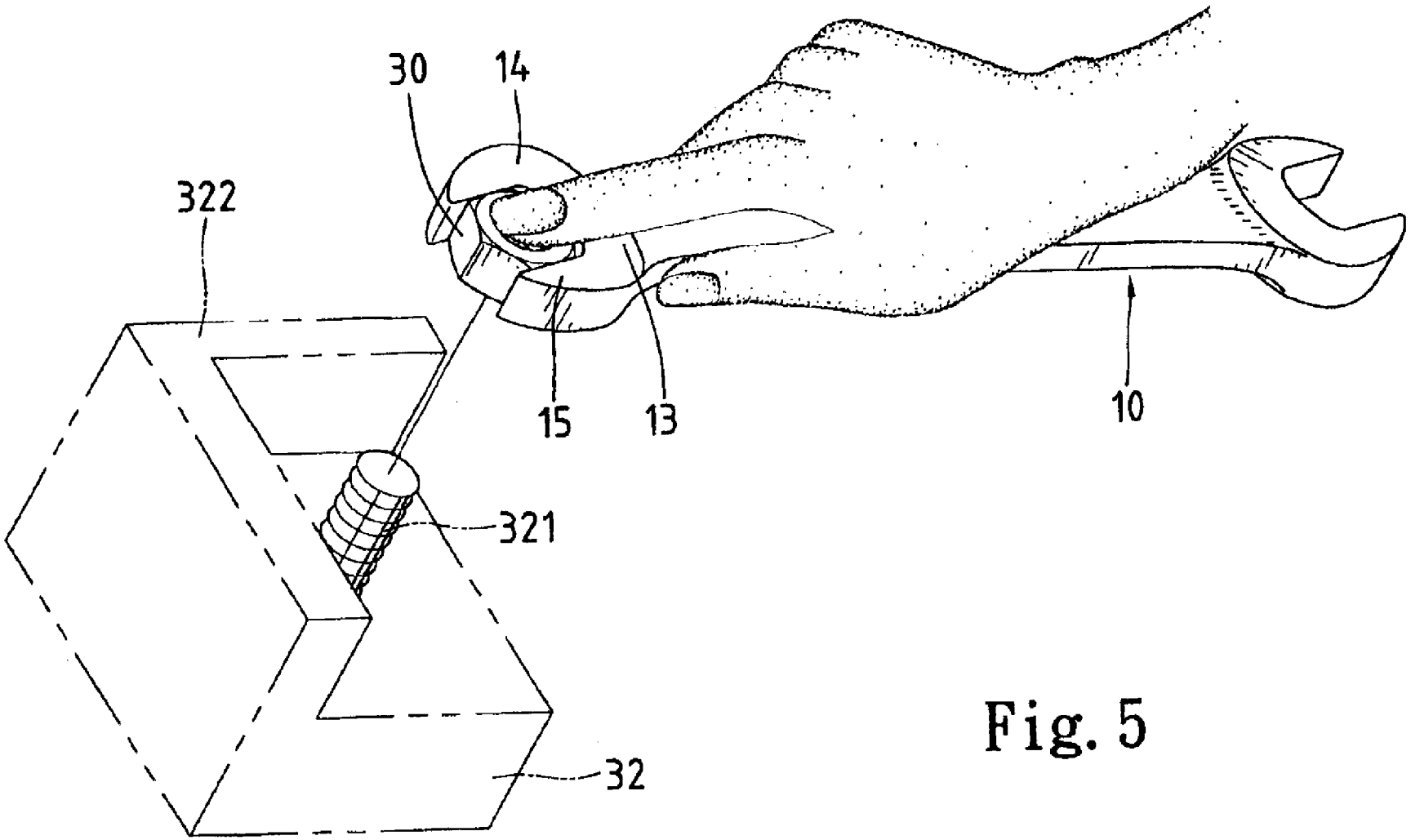
FIG. 5 is a perspective view of the wrench shown in FIG. 1 used in a second condition.

FIG. 5 shows a work 32 from which a bolt 321 and L-shaped wall 322 project. A user can secure the nut 30 onto the bolt 321 or remove the nut 30 from the bolt 321 with one hand operating the wrench 10 more easily than a conventional wrench.

Figure 6:
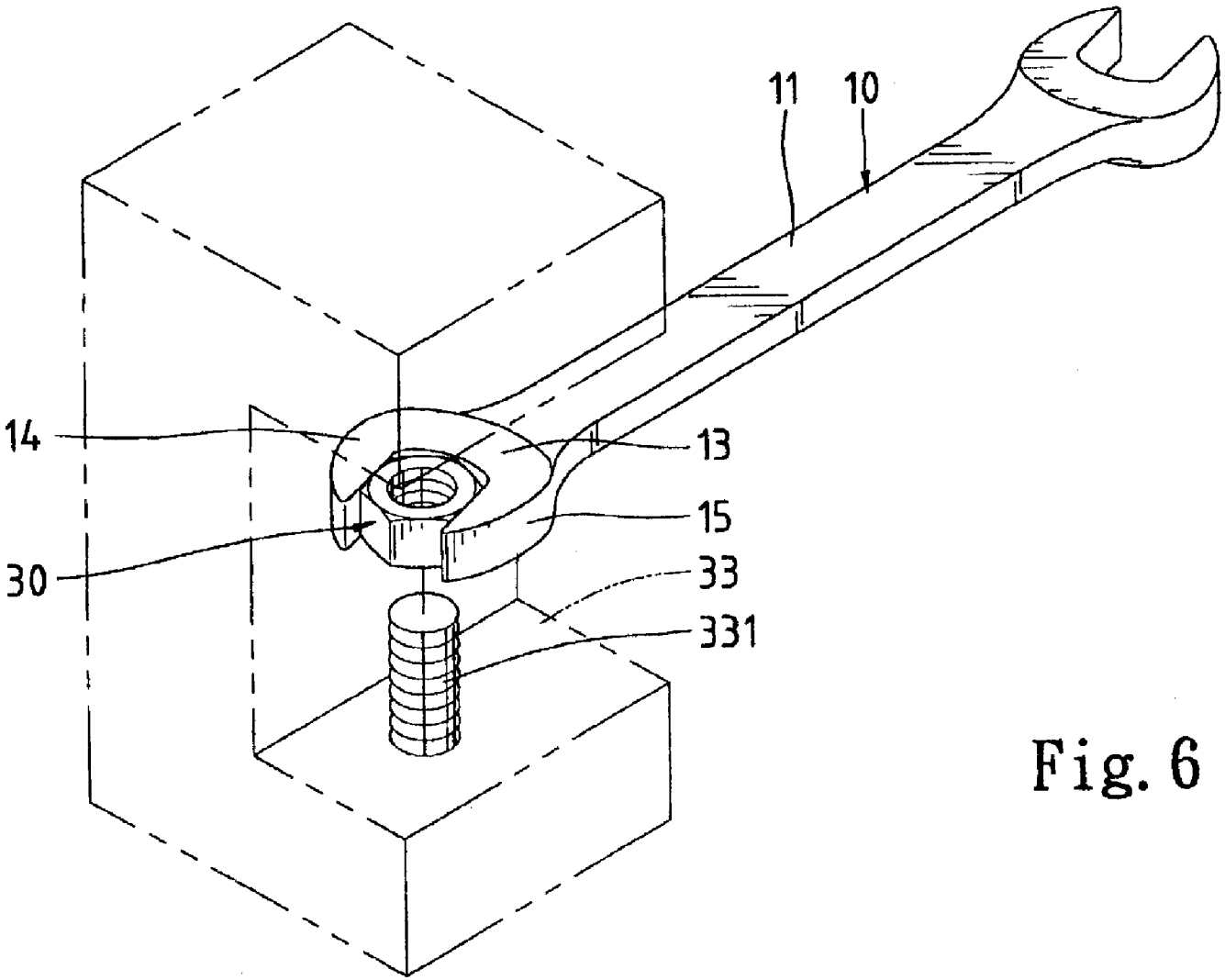
FIG. 6 is a perspective view of the wrench shown in FIG. 1 used in a third condition.

FIG. 6 shows a work 33 with two plates (not numbered). A bolt 331 extends from one of the plates of the work 33. A user can secure the nut 30 onto the bolt 331 or remove the nut 30 from the bolt 331 with one hand operating the wrench 10 more easily than a conventional wrench.

Figure 7:
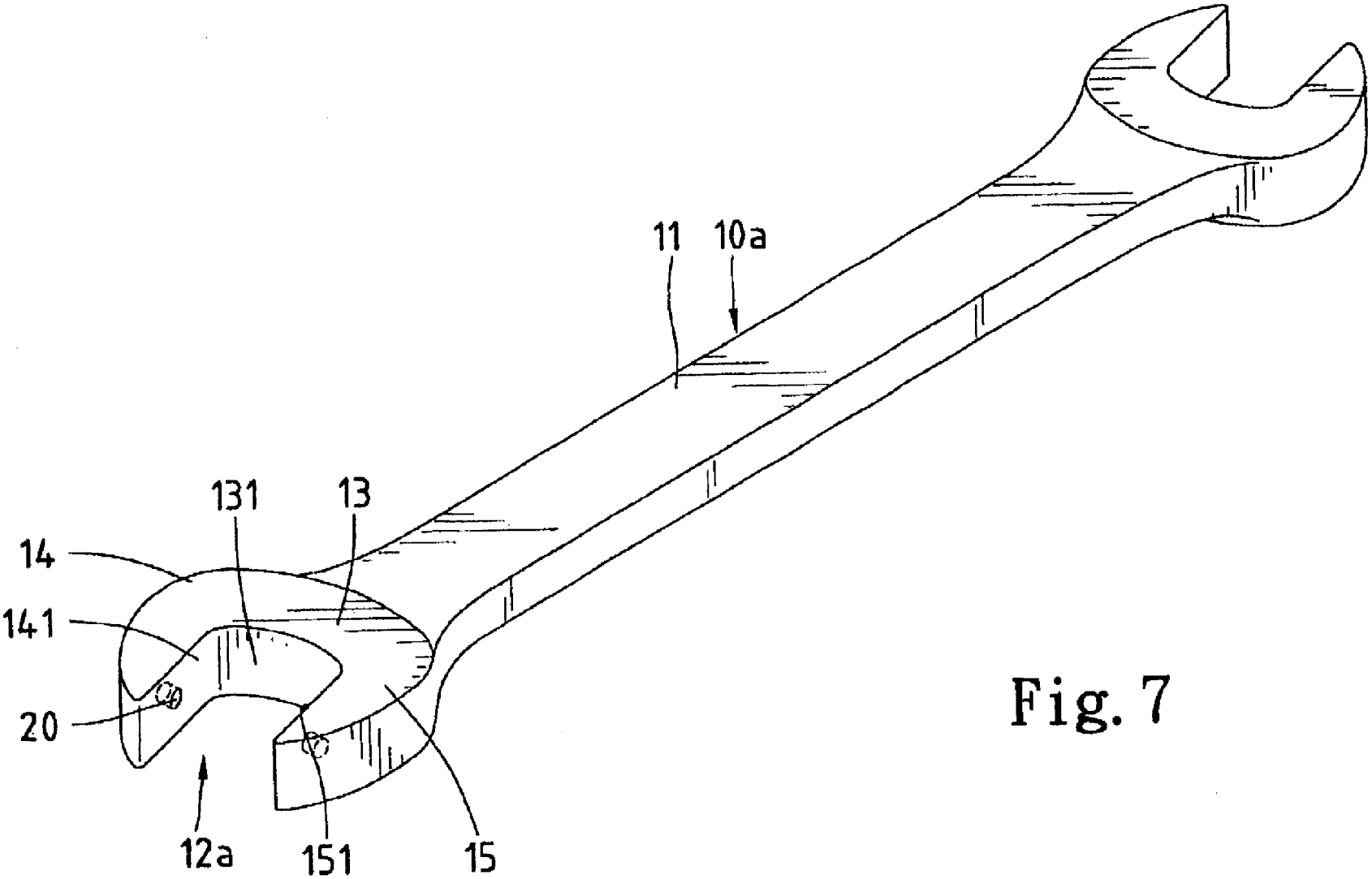
FIG. 7 is a perspective view of a wrench according to a second embodiment of the present invention.

FIG. 7 shows a wrench 10*a* according to a second embodiment of the present invention. The wrench 10*a* is similar to the wrench 10 except for including two magnets 20 each fit in a hole defined in one of the surfaces 141 and 151 of the head 12*a*.

Figure 8:
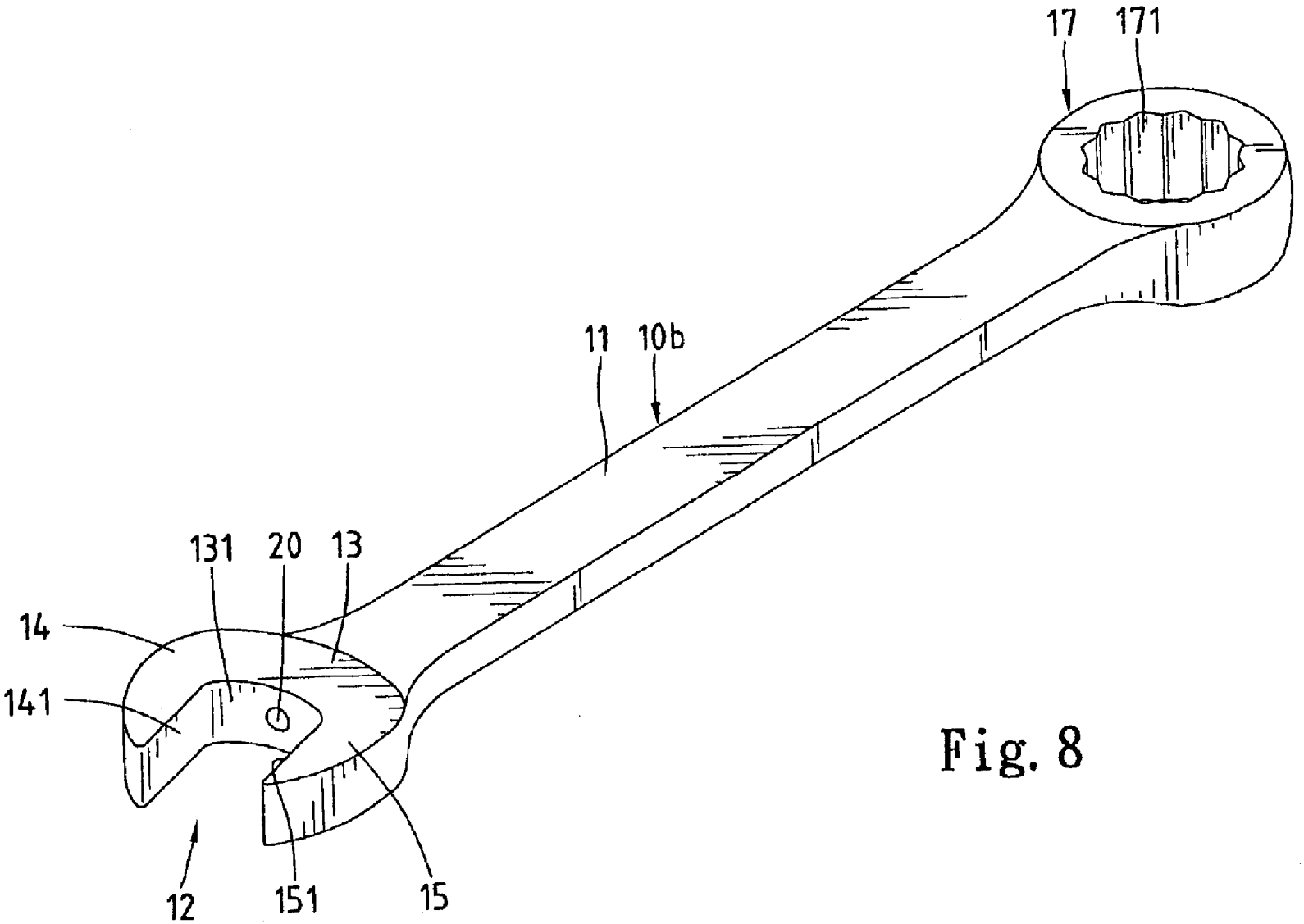
FIG. 8 is a perspective view of a wrench according to a third embodiment of the present invention.

Referring to FIG. 8, a wrench 10*b* according to a third embodiment of the present invention includes a head 12 and a ring 17. The ring 17 includes an internal surface defining a plurality of recesses 171 for receiving corners of a nut.

Figure 9:
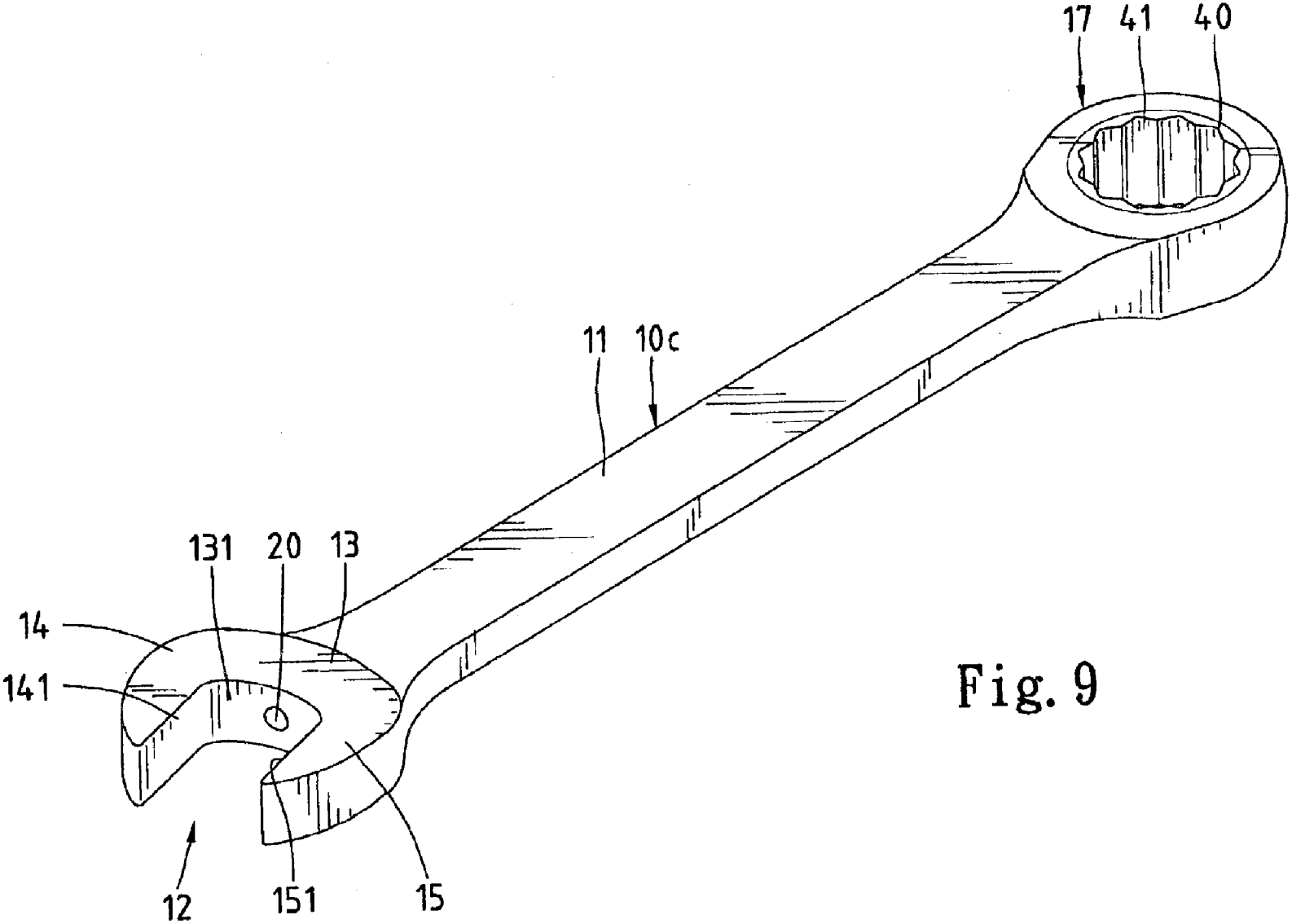
FIG. 9 is a perspective view of a wrench according to a fourth embodiment of the present invention.

Referring to FIG. 9, a wrench 10*c* according to a fourth embodiment of the present invention includes a head 12 and a ring 17. An internal ring 40 is installed in the ring 17. A ratchet mechanism (not shown) is installed between ring 17 and the internal ring 40. The internal ring 40 includes an internal surface defining a plurality of recesses 41 for receiving corners of a nut. The interconnection of the ring 17, the internal ring 40 and the ratchet mechanism is conventional and therefore will not be described in detail.

Figure 10:
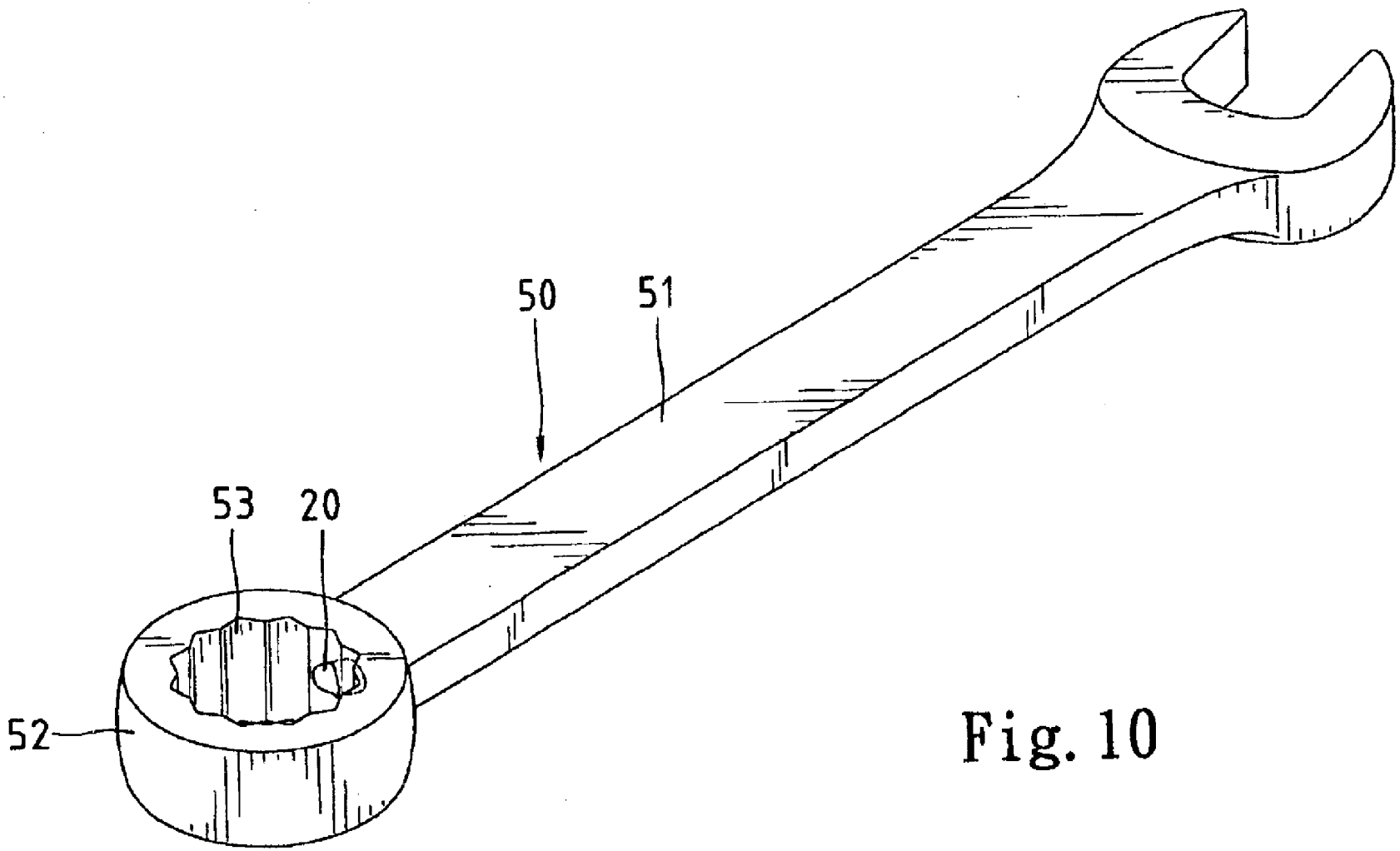
FIG. 10 is a perspective view of a wrench according to a fifth embodiment of the present invention.

Referring to FIG. 10, a wrench 50 according to a fifth embodiment of the present invention includes a handle 51 and a ring 52 formed at an end of the handle 51. The ring 52 includes an internal surface defining a plurality of recesses 53 for receiving corners of a nut. A magnet 20 is fit in a hole (not numbered) defined in the internal surface of the ring 52.

Figure 11:
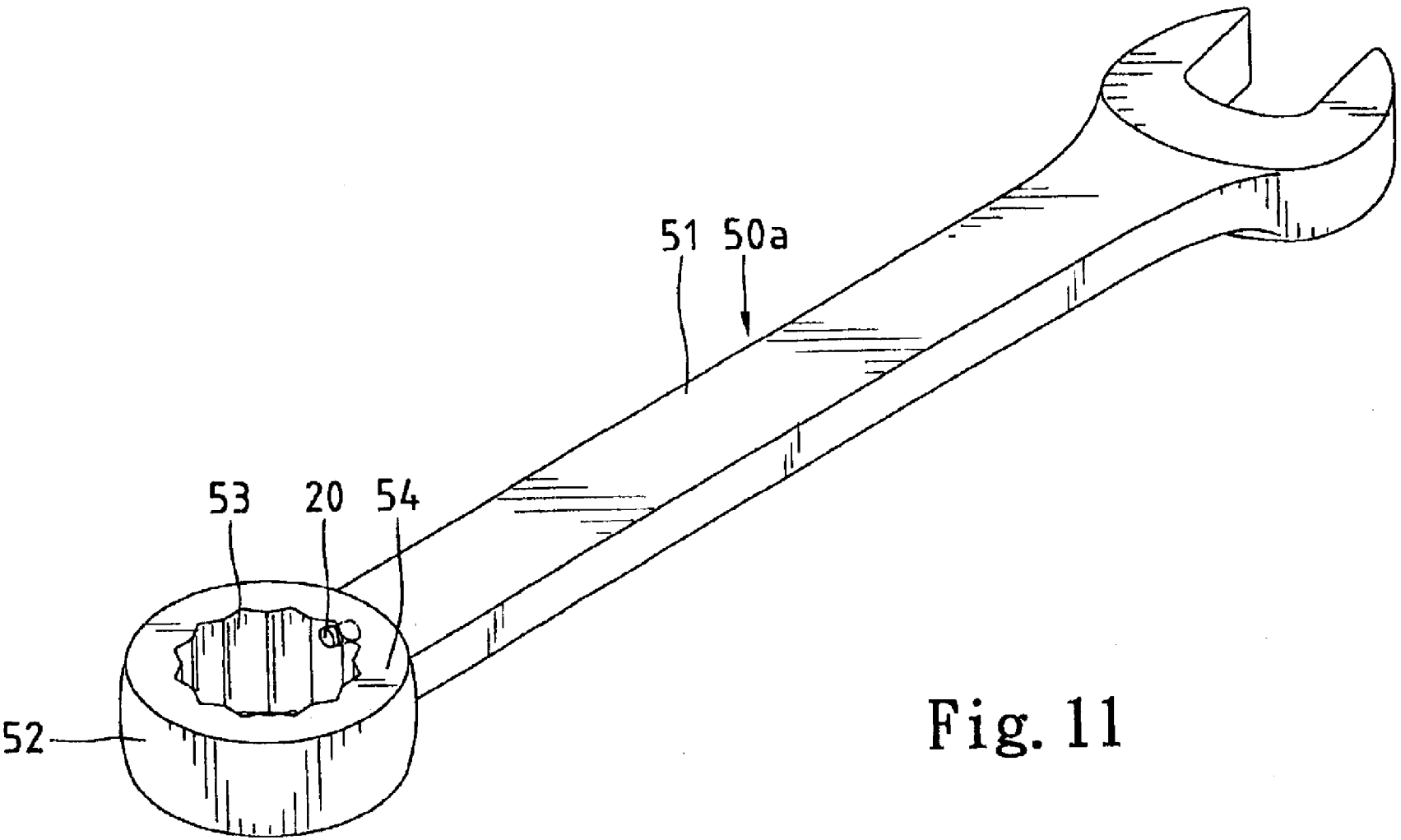
FIG. 11 is a perspective view of a wrench according to a sixth embodiment of the present invention.
Figure 12:
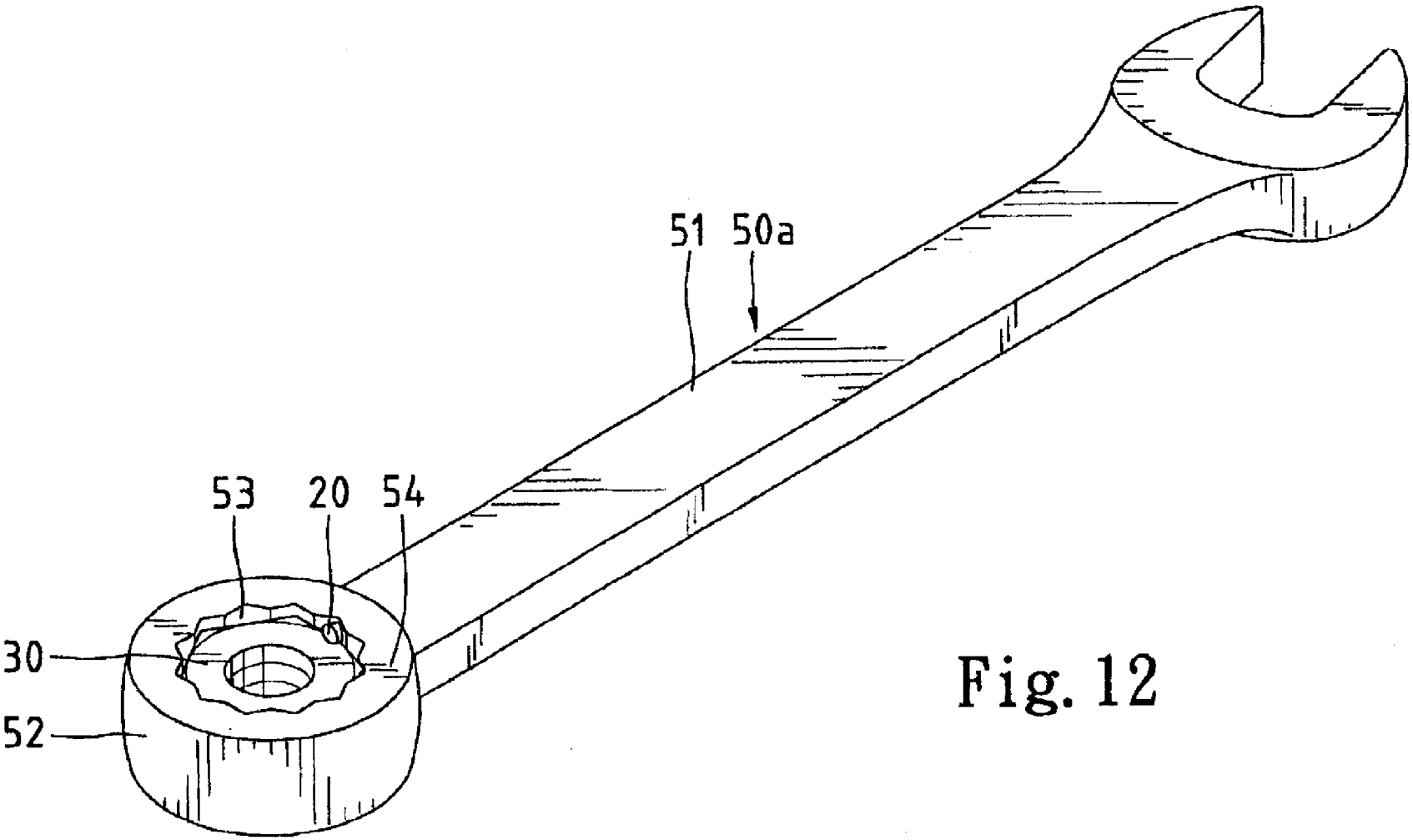
FIG. 12 is a perspective view of the wrench shown in FIG. 11 engaged with a nut.

FIGS. 11 and 12 show a wrench 50*a* according to a sixth embodiment of the present invention. The wrench 50*a* is similar to the wrench 50 except for that a tip of the magnet 20 is located outside a hole (not numbered) defined in the internal surface of the ring 52. Thus, the tip of the magnet 20 performs as a stop for preventing a nut from passing beyond a top surface 54 of the ring 52.

Figure 13:
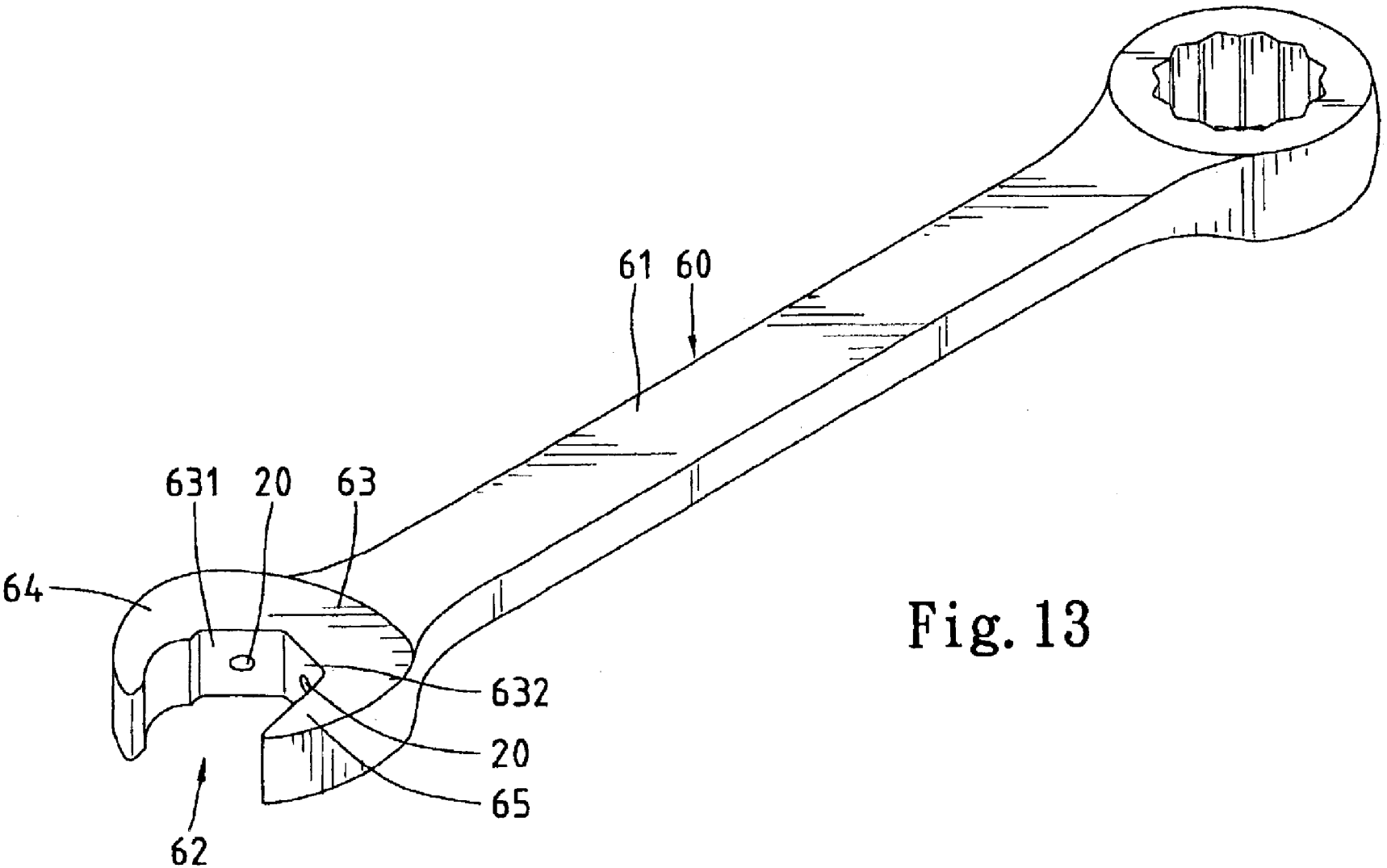
FIG. 13 is a perspective view of a wrench according to a seventh embodiment of the present invention.

FIG. 13 shows a quick-release wrench 60 according to a seventh embodiment of the present invention. The wrench 60 includes a handle 61 and at least one head 62 formed at an end of the handle 61. The head 62 includes an intermediate portion 63 and a pair of jaws 64 and 65 extending from the intermediate portion 63. The intermediate portion 63 includes two surfaces 631 and 632 for contact with two adjacent facets of a nut. A magnet 20 is fit in a hole defined in each of the surfaces 631 and 632.

Figure 14:
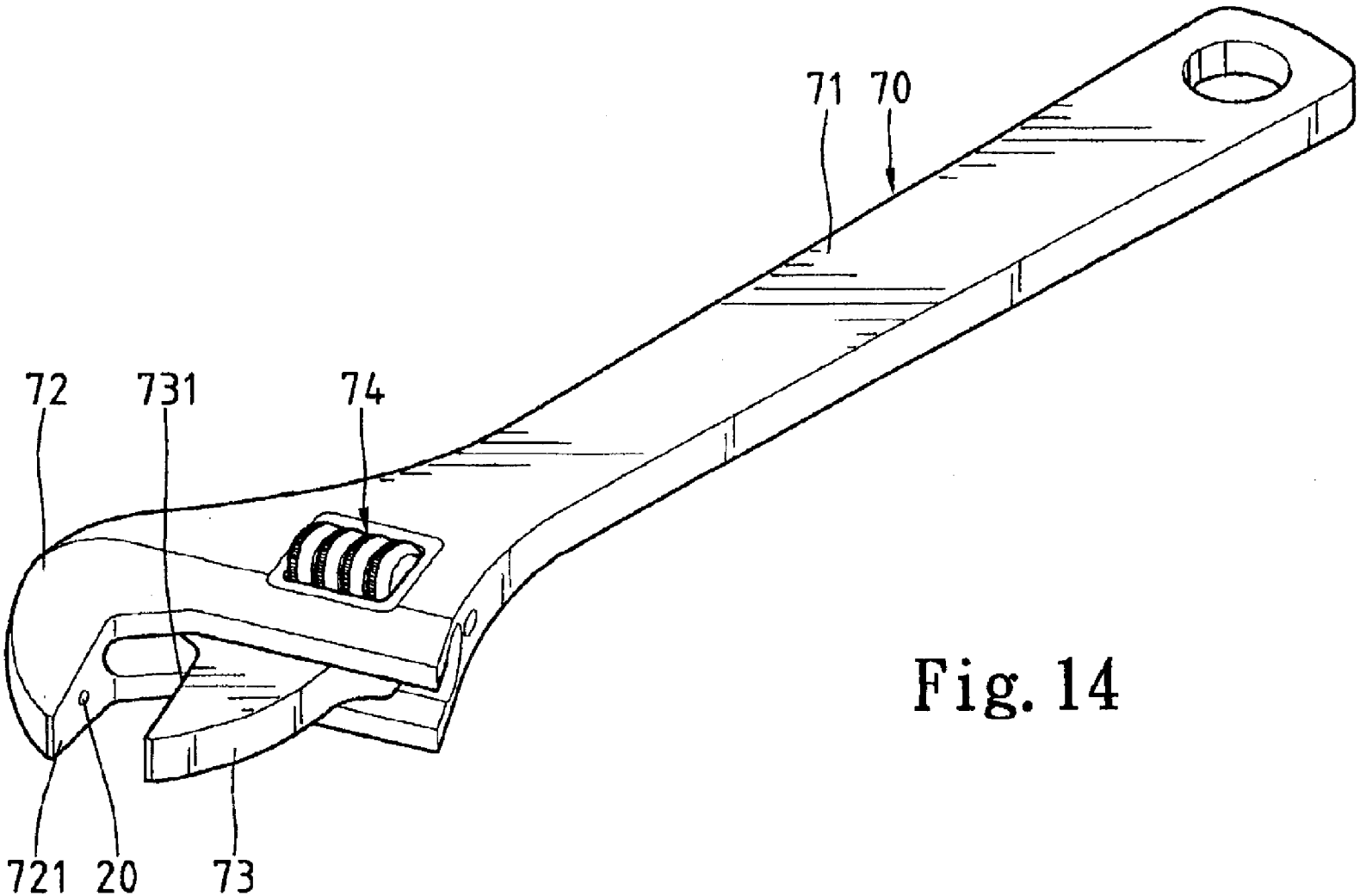
FIG. 14 is a perspective view of a wrench according to an eighth embodiment of the present invention.

FIG. 14 shows an adjustable wrench 70 according to an eighth embodiment of the present invention. The adjustable wrench 70 includes a handle 71, a fixed jaw 72 projecting from the handle 71 and a movable jaw 73 mounted thereon. The fixed jaw 72 includes a surface 721. The movable jaw 73 includes a surface 731. The surfaces 721 and 731 arc parallel to each other for contact with two parallel facets of a nut. The movable jaw 73 can be moved toward and away from the fixed jaw 72 by operation of a worm and rack mechanism 74. A magnet 20 is fit in the fixed jaw 72.

Figure 15:
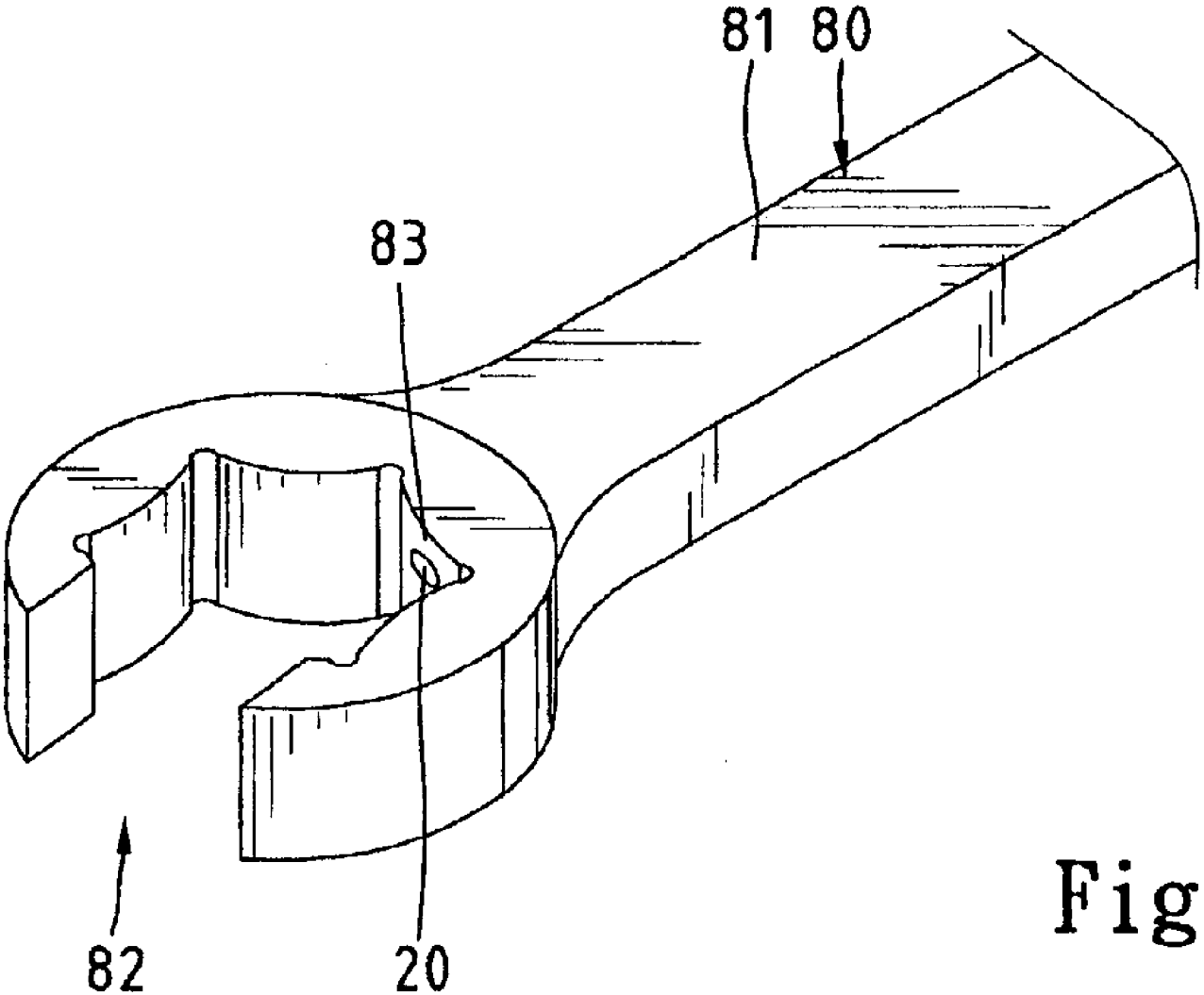
FIG. 15 is a perspective view of a wrench according to a ninth embodiment of the present invention.

FIG. 15 shows a wrench 80 according to a ninth embodiment of the present invention. The wrench 80 includes a handle 81 and at least one head 82 formed at an end of the handle 81. The head 82 is like a broken ring including a plurality of facets 83 for contact with facets of a nut. A magnet 20 is fit in a hole defined in one of the facets 83.

The present invention has been described through detailed illustration of several embodiments. Those skilled in the art can derive variations from the embodiments without departing from the scope of the present invention. Therefore, the preferred embodiment shall not limit the scope of the present invention. The scope of the present invention can only be defined in the attached claims.

What is claimed is:

1. A wrench comprising, in combination: a handle; a head formed at an end of the handle for engagement with a nut having a threadable axis, with the handle integrally formed as a single piece with the head and extending generally perpendicular to the threadable axis and for manual grasping in a handle of a user; and a magnet at least partially embedded in the head for keeping the nut in the head.

2. The wrench according to claim 1 wherein the head includes an intermediate portion formed with the end of the handle and two jaws extending from the intermediate portion.

3. A wrench comprising, in combination: a handle; a head formed at an end of the handle for engagement with a nut; and a magnet at least partially embedded in the head, wherein the head includes an intermediate portion and two jaws extending from the intermediate portion, wherein the magnet is embedded in the intermediate portion.

4. The wrench according to claim 2 wherein the magnet is embedded in one of the jaws.

5. The wrench according to claim 4 including two magnets each embedded in one of the jaws.

6. The wrench according to claim 2 including another head formed at another end of the handle.

7. The wrench according to claim 2 including a ring formed at another end of the handle for engagement with the nut.

8. The wrench according to claim 2 including an external ring formed at another end of the handle, an internal ring installed in the external ring for engagement with the nut and a ratchet mechanism installed between the external ring and the internal ring.

9. The wrench according to claim 1 wherein the head is a ring.

10. The wrench according to claim 9 wherein the magnet is embedded in the ring at the end of the handle.

11. A wrench comprising, in combination: a handle; a head formed at an end of the handle for engagement with a nut; and a magnet at least partially embedded in the head, wherein the head is a ring, wherein the magnet is embedded in the ring, wherein the magnet includes a first tip embedded in the ring and an exposed second tip for performing as a stop for the nut.

12. The wrench according to claim 1 wherein the wrench is a quick-release wrench and the head includes an intermediate portion formed with the end of the handle, and with the head further including two jaws extending from the intermediate portion.

13. The wrench according to claim 12 wherein the intermediate portion includes two surfaces for contact with two adjacent facets of the nut and the magnet is embedded in one of the surfaces.

14. The wrench according to claim 13 including two magnets each embedded in one of the surfaces.

15. The wrench according to claim 1 wherein the wrench is an adjustable wrench, with the head including a fixed jaw projecting from the handle, a movable jaw mounted thereon and a worm and rack mechanism for moving the movable jaw relative to the fixed jaw.

16. The wrench according to claim 15 wherein the magnet is embedded in one of the jaws.

17. The wrench according to claim 16 wherein the magnet is embedded in the fixed jaw.

18. The wrench according to claim 1 wherein the head is shaped as a broken ring including a plurality of facets for contact with facets of the nut, wherein the magnet is embedded in one of the facets of the head.

19. The wrench according to claim 11 with the head being integrally formed as a single piece with the end of the handle, with the head adapted to engage the nut having a threadable axis, with the handle extending generally perpendicular to the threadable axis and for manual grasping in the hand of a user, with the magnet embedded in the ring at the end of the handle.

20. The wrench according to claim 3 with the head being integrally formed as a single piece with the end of the handle, with the head adapted to engage the nut having a threadable axis, with the handle extending generally perpendicular to the threadable axis and for manual grasping in the hand of a user.

* * * * *